US005394622A

United States Patent [19]

Evans et al.

[11] Patent Number: 5,394,622

[45] Date of Patent: Mar. 7, 1995

[54] METHOD AND APPARATUS FOR A MECHANICAL DRYER FOR DRYING THICK POLYMER LAYERS ON A SUBSTRATE

[75] Inventors: Kent J. Evans, Lima; Warren R. Smith, Webster; Robert F. Dunham, Walworth; Timothy J. Leenhouts, Fairport, all of N.Y.; Barbara D. Ceglinski, Oklahoma City, Okla.; Richard A. Cairncross, St. Paul, Minn.

[73] Assignee: Xerox Corporation, Stamford, Conn.

[21] Appl. No.: 76,672

[22] Filed: Jun. 15, 1993

[51] Int. Cl.[6] ..... F26B 19/00

[52] U.S. Cl. ..... 34/494; 34/496; 34/210

[58] Field of Search ..... 34/155, 156, 160, 18, 34/60, 62, 218, 79, 48, 4, 210, 215, 494, 496, 210; 118/620, 641, 643, 65, 67, 68; 427/372.2

[56] References Cited

U.S. PATENT DOCUMENTS 3,151,950 10/1964 Newman et al. ..... 118/642 X
4,127,945 12/1978 Nöthen et al. ..... 34/155
4,406,388 9/1983 Takashi et al. ..... 34/156 X
4,475,294 10/1984 Henricks ..... 34/79
4,495,713 1/1985 Williner ..... 34/48 X
4,786,570 11/1988 Yu et al. .

*Primary Examiner*—Henry A. Bennett
*Attorney, Agent, or Firm*—Oliff & Berridge

[57] ABSTRACT

A dryer with zone temperature controls for drying thick polymer-solvent layers on a substrate. The dryer is formed with several heating elements located in an air duct. The cool air is heated a specific amount as it passes each heating element. The heated air is then applied to the polymer-solvent solution on the substrate in a continuous fashion so that the polymer-solvent solution slowly heats up as it passes through the drying apparatus. The preferred design is to ensure a zone residence time of less than 10 seconds and a web heating rate of 10° F./second or less. Most preferred design is a zone residence time less than 5 seconds and a heating rate less that 5° F./second. The dryer is designed to have a continuous temperature gradient, especially in the critical later stages of drying when the solvent content of the film is less than 20%.

21 Claims, 8 Drawing Sheets

METHOD AND APPARATUS FOR A MECHANICAL DRYER FOR DRYING THICK POLYMER LAYERS ON A SUBSTRATE

ORIGIN OF THE INVENTION

This invention was made with government support under grant number ECD-8721551 awarded by the National Science Foundation. The government has certain rights in the invention.

BACKGROUND OF THE INVENTION

1. Field of the Invention

This invention relates to improvements in mechanical dryers for drying thick polymer-solvent layers on a substrate. More particularly, this invention is for producing and controllably applying a gradient-temperature heated air to a substrate having a thick polymer-solvent layer in order to avoid forming bubbles in the polymer layer during drying.

2. Description of the Related Art

Conventionally, it has been recognized that the latter stage of polymer solution drying is controlled by diffusion, but the application of diffusion controlled drying on dryer design has not been fully appreciated. This is largely because experiments performed imply a strong concentration dependence for the rate of diffusion. At present it appears that the dependence is even greater than that represented by existing semi-empirical diffusion models.

The typical industrial dryer for drying a polymeric coating consists of a series of zones each with a controlled temperature and airflow rate. A high drying rate enhances the process speed but may be detrimental to the quality of a final coating because of effects such as "skinning" and boiling of the solvent. The drying of polymeric films in manufacturing situations is carried out in dryers consisting of different zones. The solution of polymers and solvents is applied to a substrate by using a coater. The substrate can be a variety of materials and surfaces. An example is a web matrix used for photoreceptor belts.

The substrate with the wet film enters a series of temperature zones, each of which is at a determined temperature by applying a controlled flow of heated air. When the design in the dryer does not allow for increased temperature or airflow, air convection dryers can be augmented by supplying energy directly to the bulk of the drying film by exposing it to some sort of radiation that can be absorbed by the film. The temperatures, airflow rates and the speed of the substrate are chosen such that the residual solvent concentration at the end of the drying process is acceptable while providing the maximum yield.

Modeling the process permits optimizing the design of the dryer and to identify potential trouble spots. One problem is the boiling of the solvent in the wet film, which can result in the formation of defects in the final product, such as bubbles. Current dryer design strategies utilize high heat transfer rates and only a few relatively long temperature zones. Generally, this type of dryer design is inefficient in maximizing solvent removal rates and generally ineffective in preventing bubble formation. These small bubble formations in polymer layer, such as a small molecule transport layer of a flexible photoreceptor belt, have been a significant problem for years.

Despite early improvements in dryers, no further progress has been made in the last few years. Recently, extensive experiments in the mechanism of small molecule transport layer drying have demonstrated that conventional dryer designs such as longer zones, air bar design, and lower temperatures, cannot solve the problem. The only way to eliminate small molecule transport layer bubbles is by careful temperature profiling of a dryer.

SUMMARY OF THE INVENTION

The present invention is drawn to a dryer design having a continuous temperature gradient throughout the dryer, especially in the critical latter stages of drying, where the solvent content of the film is less than 20%. Even though the ideal and most preferred situation is to have a continuous temperature gradient, it is possible to build a dryer with discrete temperature zones that approximates the ideal. In this case, the preferred embodiment is to ensure a zone residence time of less than 10 seconds and a web heating rate of 10° F./second or less. Most preferred zone residence times are less than 5 seconds with heat rates of 5° F./second or less.

Heating rate control can be accomplished by any number of methods that may depend on whether the dryer design is for a new build or for the modification of an existing design. Examples of temperature profile control include: 1) Mixing of cooler air in variable amounts along the length of the zone; 2) By adding internal duct heaters in the dryer air nozzle feeds; 3) Installing radiant heaters between the air bars; or 4) any combination of the above.

BRIEF DESCRIPTION OF THE DRAWINGS

The present invention is illustrated in the accompanying drawings, in which like reference numerals are used to denote like or similar parts, and wherein.

DETAILED DESCRIPTION OF THE PREFERRED EMBODIMENTS

Drying a polymer-solvent solution is strongly affected by the variation of diffusivity, solvent vapor pressure and solvent activity with temperature and composition. The sensitivity of the drying characteristics to the diffusion coefficients is affected by their dependence on solvent concentration and ambient temperature. In polymeric solutions, diffusion coefficients will generally drop as the concentration of solvents decreases, the temperature decreases and/or the molecular weight of the polymers increases. The latent heat of vaporization acts as a heat sink at the upper surface of the film, causing a significant evaporative cooling in the early stages of the drying. This region is commonly known as the constant rate drying regime.

As the solvent concentration reduces, the limiting factor of the drying rate is the rapidly falling diffusion coefficients. When the solvent concentration is sufficiently reduced, the drying process enters what is known as the diffusion controlled regime. In the diffusion controlled regime, the strong dependence of the diffusion coefficient on solvent concentration causes the drying rate to drop sharply when the solvent level is reduced. Thus, the residual volume of solvent essentially levels off in the latter zones, slowing the removal of additional solvent. In this regime, the residual solvent concentration depends mainly on the temperature of the zone. Thus, higher temperatures are necessary to remove more solvent.

In addition, during the diffusion controlled phase of drying within a particular temperature zone, two distinct drying regions (or periods) occur. In the first period, the web temperature is changing and the solvent removal rate is relatively high. In the second period, the web temperature is in equilibrium with the dryer temperature and the solvent removal rate is very low. The difference in drying rate between these two periods can be dramatic, with up to 90% or more of the solvent loss within each temperature zone occurring during the first period. This is significant because the first period typically occupies only a small fraction of the total length of the temperature zone and it follows that the zone is too long for economically efficient drying.

Figure 1:
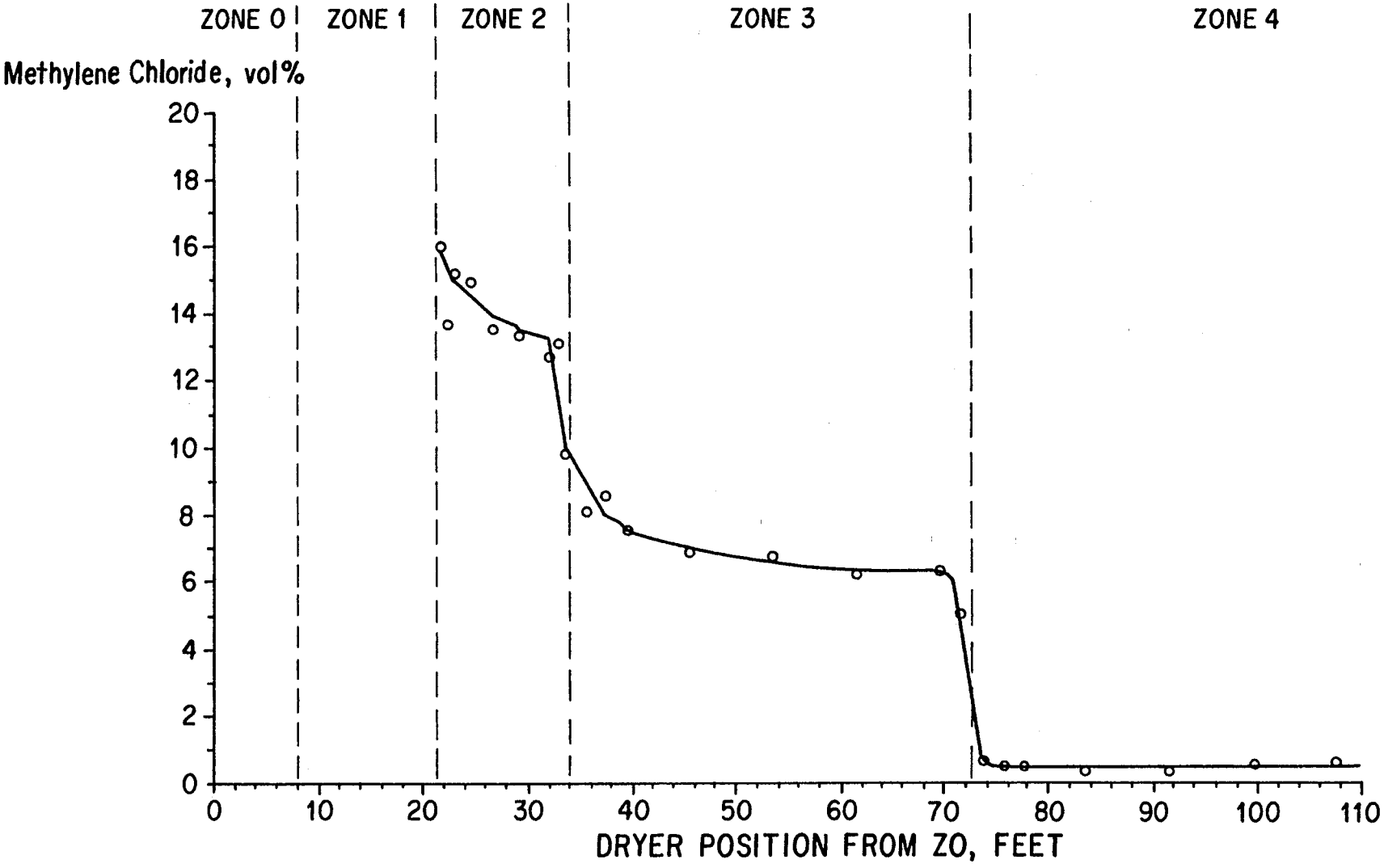
FIG. 1 shows the volume residual solvent left on the photoreceptor belt as it passes through the apparatus of the prior art.
Figure 2:
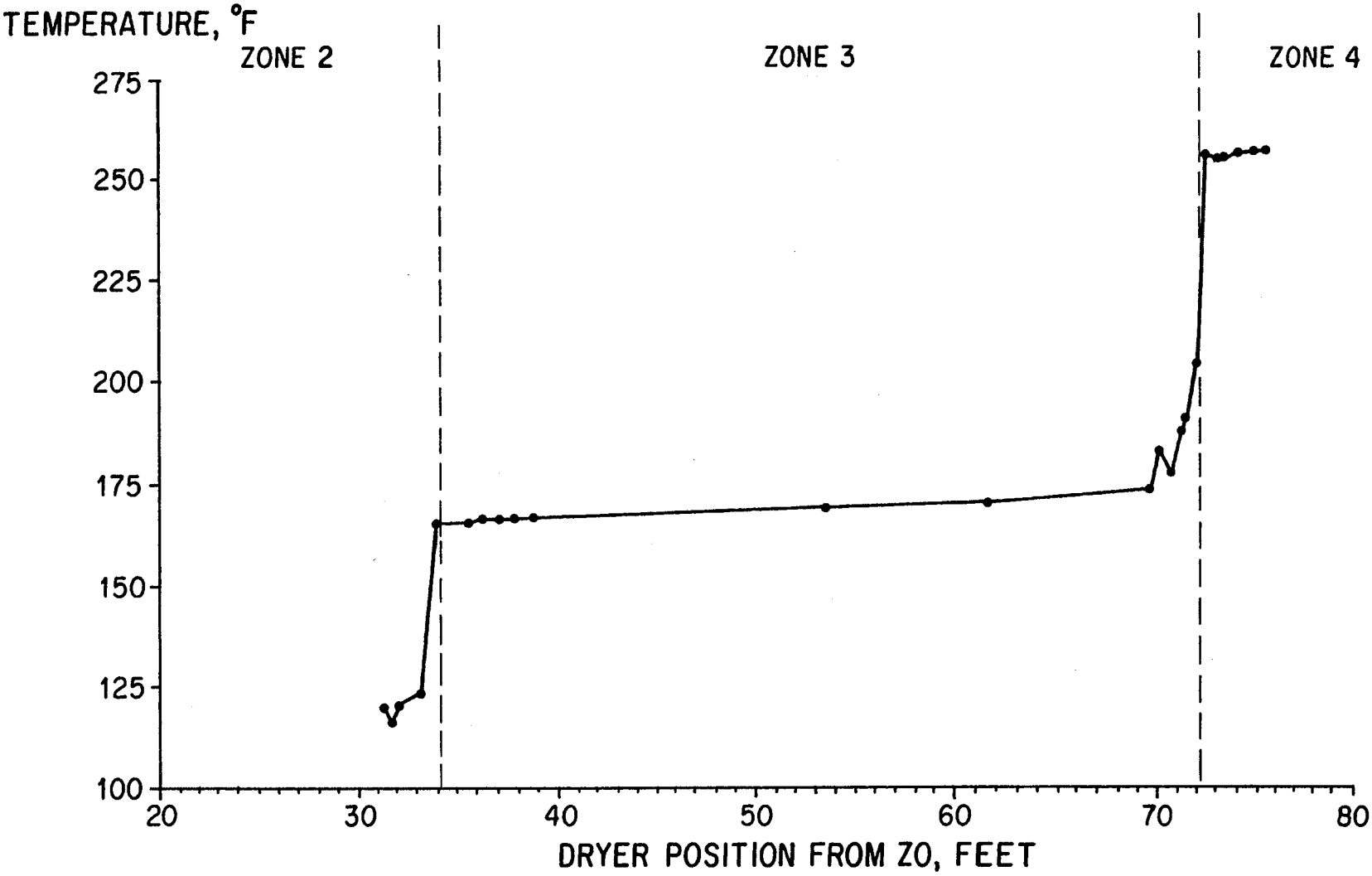
FIG. 2 shows the web temperature profile as the web passes though the apparatus of the prior art.

An example of the drying process described above is shown in FIGS. 1 and 2. FIG. 1 shows a diagram of the residual solvent in a multizone dryer and a corresponding diagram of the web temperature is shown in FIG. 2. By comparing FIGS. 1 and 2, it can be seen that the solvent evaporates at a useful rate only when the temperature of coating is changing. Once the temperature of the polymer-solvent is constant, the drying process essentially stops. Therefore, the rest of the time spent in the drying zone accomplishes little. Note from FIG. 1, 80 to 99% of the solvent removal is occurring in the first 10 to 20% of each zone.

One consequence of this type of drying is that, the exit temperature of the dryer becomes essentially fixed by residual solvent specifications. The solvent is effectively removed only when the substrate temperature increases. Solvent removal during the second drying period of the drying zone is slow and contributes little to residual solvent reduction. From FIGS. 1 and 2, it follows that the optimum dryer design (i.e. shortest dryer) will have a continuous temperature ramp during the diffusion controlled phase of drying.

An additional problem is boiling of the coating if the temperature differential between zones is too large and too abrupt. This has been demonstrated with an air flotation dryer design of the prior art.

Figure 3:
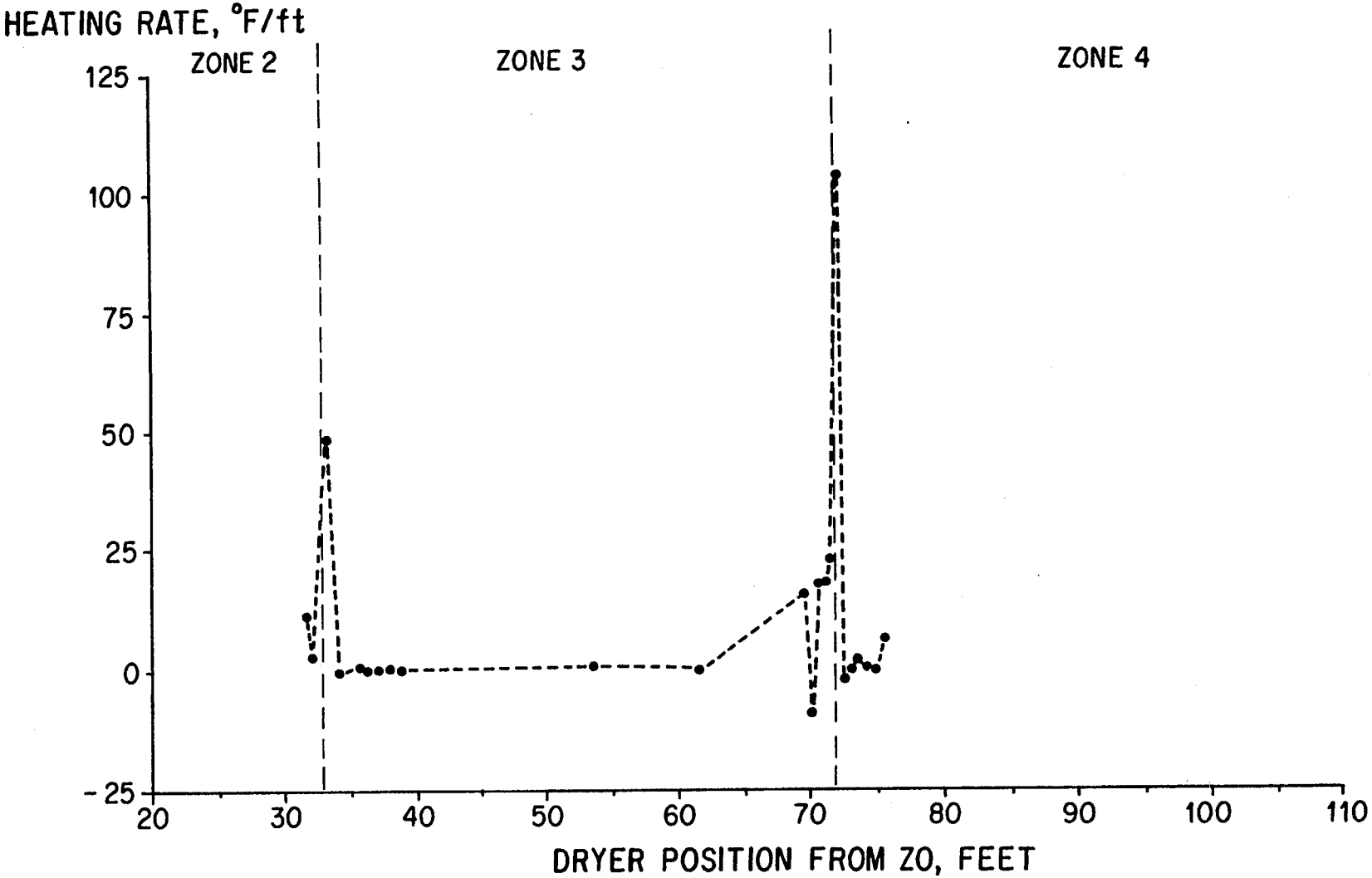
FIG. 3 shows the web heating rate profile as the web passes through the apparatus of the prior art.

FIG. 3 shows the substrate, or web, heating rate for the last three zones of a four zone air flotation dryer of the prior art. Note that heating rates of 20° F. to over 100° F. per second are achieved (typical for a dryer of this type).

Figure 4:
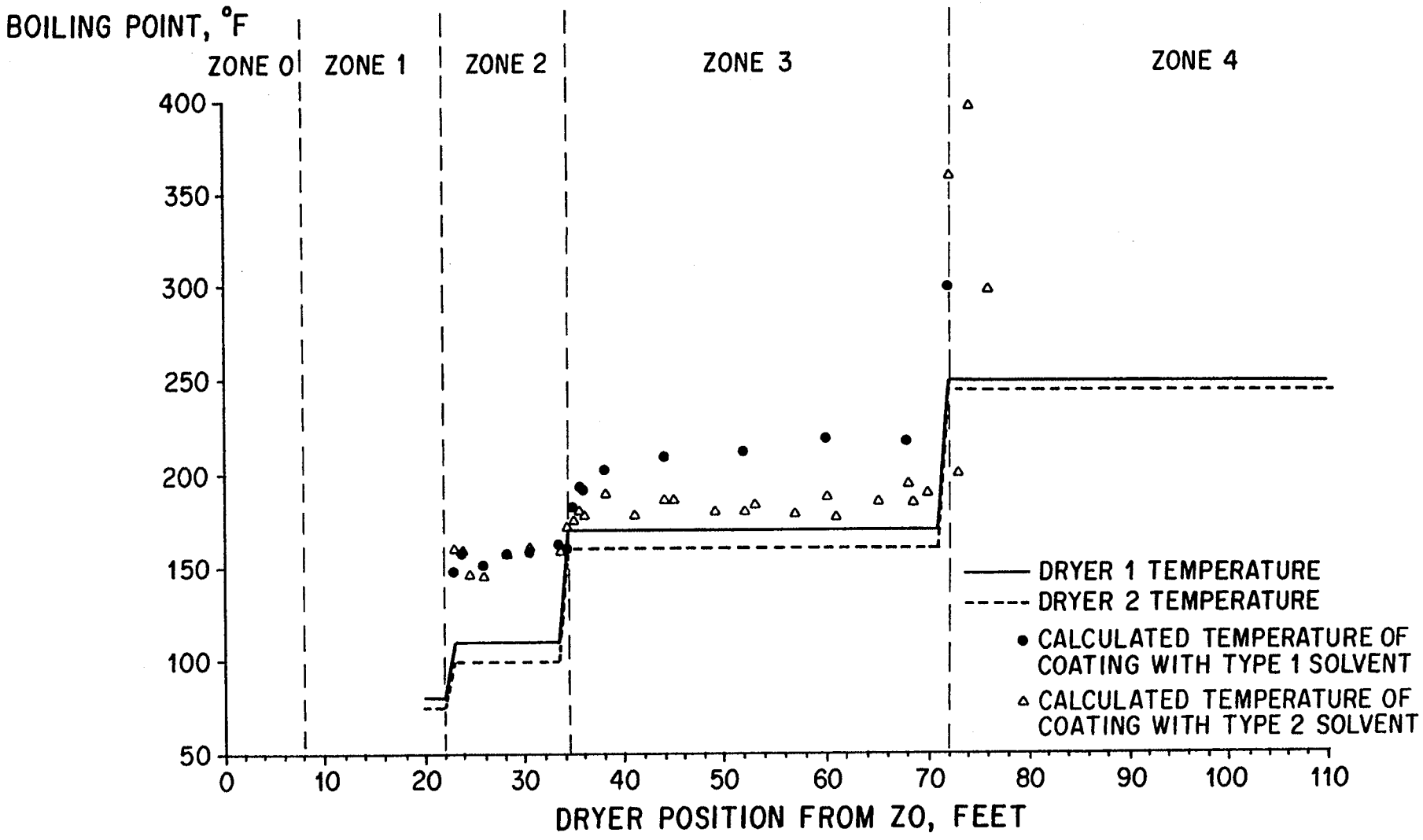
FIG. 4 shows the boiling point of the coating and the web temperature as it passes through the apparatus of the prior art.

FIG. 4 shows the coating average boiling point, also referred to as the bubble point, for the last three zones of the dryer. The bubble point temperatures are calculated from residual solvent measurements. The solid and dotted lines represent the dryer temperature in each temperature zone. The temperature is constant throughout each zone and increases sharply at the transition point between zones. The calculated boiling points of the coatings of two polymer-solvents are represented by individual points (circles and triangles) in FIG. 4.

In order to prevent small bubbles from forming on the web, the actual temperature of the coating must not exceed the bubble temperature of the solution at any time. Thus, the dryer temperature should always be less than the average bubble temperature of the coating. However, at the transition point between temperature zones in FIG. 4, the dryer temperature approaches or even exceeds the coating temperature. Therefore, such a dryer that has sharp increases in temperature between zones can and does cause the formation of bubbles in the coating.

In contrast, old style arch type dryers showed much lower heating rates (5° F. or less) between zones. The result was a much softer web temperature profile at the zone transitions. In these dryers, the web temperature did not exceed the coating boiling point at the zone transitions and bubble formation was eliminated. The problem with these dryers was that the length of the dryer had to be very long in order to increase the temperature of the solvent to the final temperature. Since these dryers were so long, they were inefficient and expensive.

Figure 5:
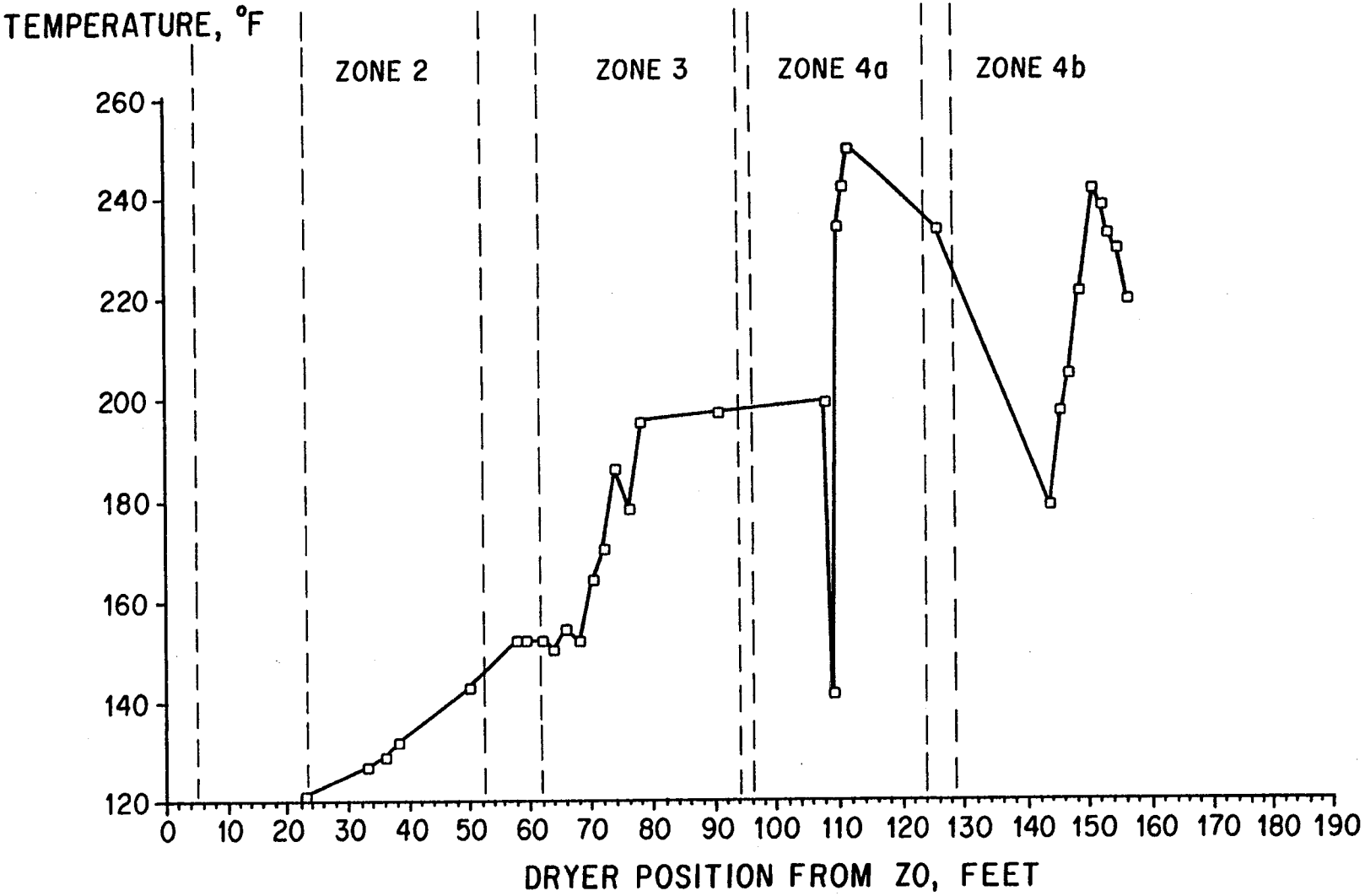
FIG. 5 shows the zone temperature profile for an arch type dryer with zone transition heating rates of 5° F./second or less.
Figure 6:
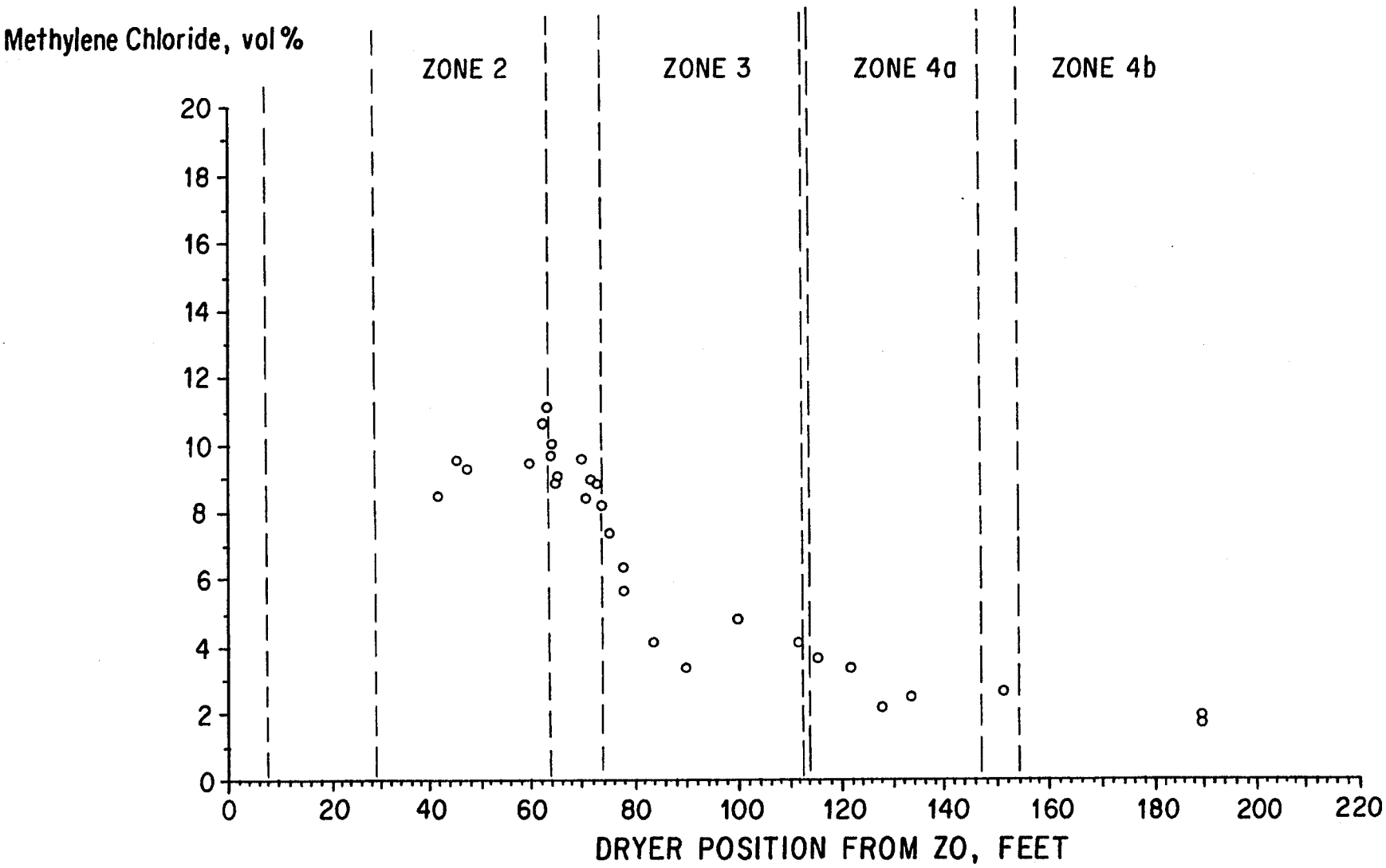
FIG. 6 shows the residual solvent profile for an arch type dryer with zone transition heating rates of 5° F./second or less.

Further, even in these old style arch dryers, residual solvent measurements, as shown in FIGS. 5 and 6, indicate that the evaporation of the solvent occurs at useful rates only in the transition regions where the temperature of the coating is changing. Again, the longer constant temperature portions of the zones were generally ineffective in removing solvent.

Accordingly, the ideal dryer should utilize a continuous temperature profile to apply the maximum end point temperature at the highest heating rate possible to the polymer-solvent without causing the formation of bubbles. This would allow for a shorter dryer and an increase in throughput without forming bubbles in the coating. Temperature or heating rate control of the diffusion controlled stages of the drying process for polymer solutions, e.g. a layer of polycarbonate/methylene chloride (also known as small molecular transport layer), is critical to accomplish this result. With air flotation dryers, heating rate control may be accomplished by the addition of numerous drying zones. Generally, these zones must be as short as possible. To be efficient, the amount of time that a portion of the substrate with the polymer-solution remains in a particular temperature zone should be less than 5 seconds. Alternatively, supplemental heating rate control (temperature profiles) could be attained by the use of piped or ducted concurrent air flow or radiant heating installed in each dryer zone. A dryer should be capable of producing heating rates of less than 10° F. per second at the zone transitions (with heating rates less than 5° F. per second preferred.)

The preferred embodiments of the present invention use very short temperature zones (low overall heating rates.) A continuous or nearly continuous change in temperature profile is generated. The preferred embodiments use zones which are shorter than the typical length in the prior art dryers. The amount of time that a portion of the substrate with the polymer-solution remains in a particular temperature zone should range from 1 second to less than 10 seconds with residence times of less than 5 seconds most preferred.

Figure 7:
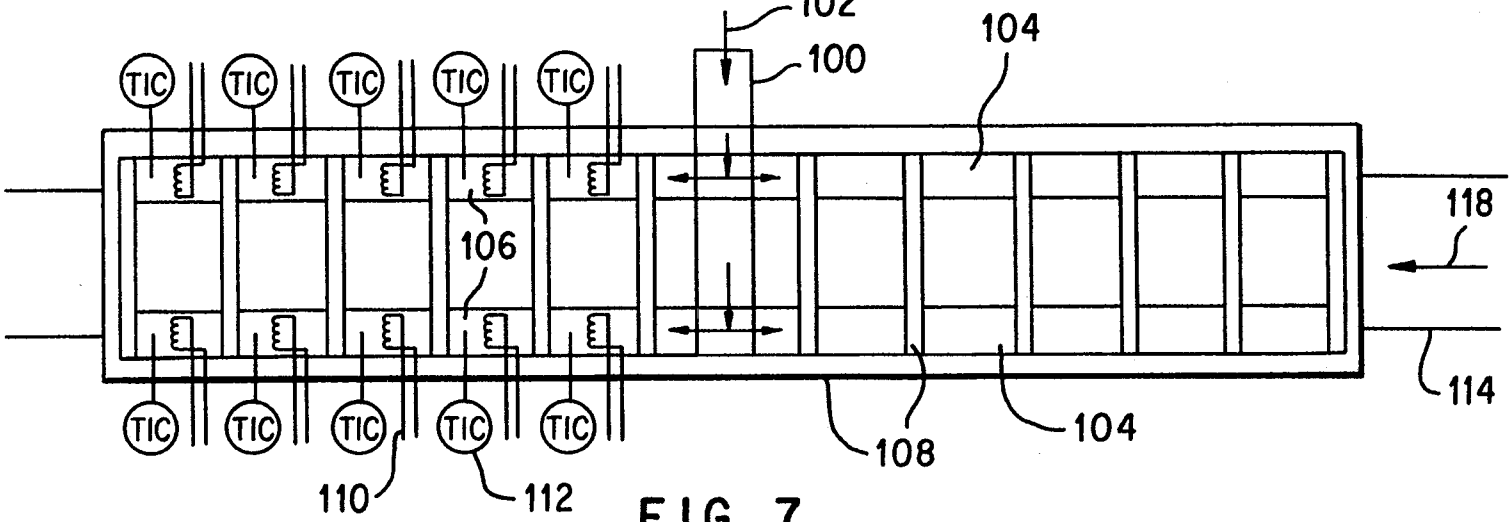
FIG. 7 is a top view of a dryer apparatus of the first preferred embodiment which has end fed nozzles.
Figure 8:
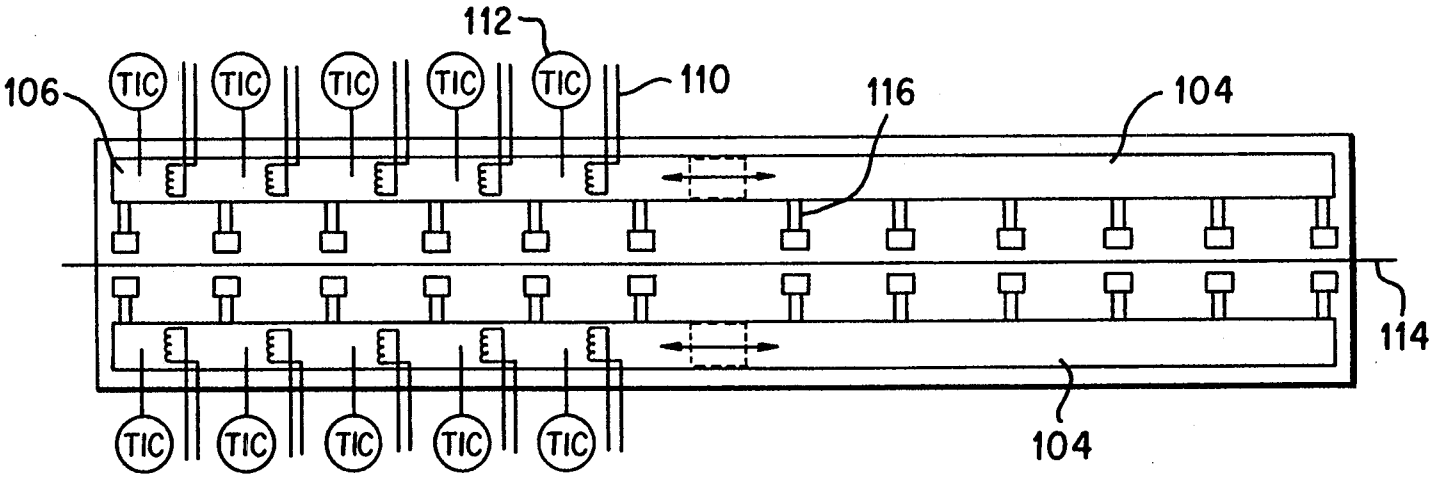
FIG. 8 is a side view of the dryer apparatus which has end fed nozzles.

The first preferred embodiment of the invention is shown in FIGS. 7 and 8. A top view of a dryer with end fed air nozzles is shown in FIG. 7. An air intake duct 100 has air forced in the direction of arrow 102 from an intake air source (not shown). The temperature of this air is lower than the bubble point of the solvent. The air can be filtered and compressed in the manufacturing plant or even a low pressure ducted air could be used.

The air is passed through the duct 100 into manifolds 104 and 106 where the air moves down the length of the manifold in the direction of the arrows 102. The substrate 114 carries a polymer-solvent layer, which was applied by a coater (not shown) before entering the dryer. The substrate 114 moves in the direction of arrow 118. Air is forced through the manifolds 104 and 106 into the air impingement nozzles 108 which are spaced along the full length of the dryer. Coanda nozzles can be used instead of impingement nozzles.

As the air moves through the manifold 106 in the downstream direction, it passes several resistive heaters (electrical heaters) 110. The temperature of the air increases as it passes each of the resistive heaters 110. Thermocouples 112 are used between the resistive heaters 110. A computer (not shown) monitors the voltage across the thermocouples 112 (which varies as a function of the temperature of the thermocouple) and determines whether the output of resistive heaters 110 should be changed to increase or decrease the temperature of the air. Another method is to connect the thermocouple 112 to a resistive heater 110 in series with a constant power supply. As the temperature of the air increases, the thermocouple's resistance increases which decreases the voltage across the resistive heater 110. The resistive heater generates less heat so that the temperature of the air begins to lower.

Accordingly, as the substrate 114 passes each of the air impingement nozzles 108, a stream of air at varying temperatures is applied across the width of the substrate 114.

A preferred modification injects cool air into the nozzle arrangement by adding, within a nozzle 108, a means of transporting cool air along the cross-sectional width of the dryer nozzle. This could be accomplished by using additional piping or ducting. If compressed air were to be used, standard piping or tubing could be set within the nozzle and cool air flow rates adjusted by varying air pressure in the injection mechanism. Control is achieved through the use of a temperature sensing element feedback in the pressure regulator or flow regulator. The addition of a fan with a concurrent ducting and variable air volume control could be used with little or no disruption of the existing methods of air transport throughout a zone. Mixing of the air streams could be performed inside the air nozzle in order to prevent alternating periods of very hot air followed by cool air. In the alternative, placement of the duct work could be within the area normally used for exhausting and recirculation of zone air.

A side view of the dryer with end-fed air nozzles is shown in FIG. 8. In this configuration, there are air nozzles 108 providing air to the top portion of the substrate 114 and the bottom portion of the substrate 114. Air supply lines 116 connect the manifolds 104 and 106 to the air impingement nozzles 108. The distance between a nozzle 108 and the substrate 114 is determined by the polymer-solvent being used, in order to have maximum drying to occur. In this configuration, the resistive heater elements 110 and temperature sensing element 112 are present in both the top portion and the bottom portion of the dryer to independently control the temperature of the air applied to the top and bottom of the substrate, respectively.

Figure 9:
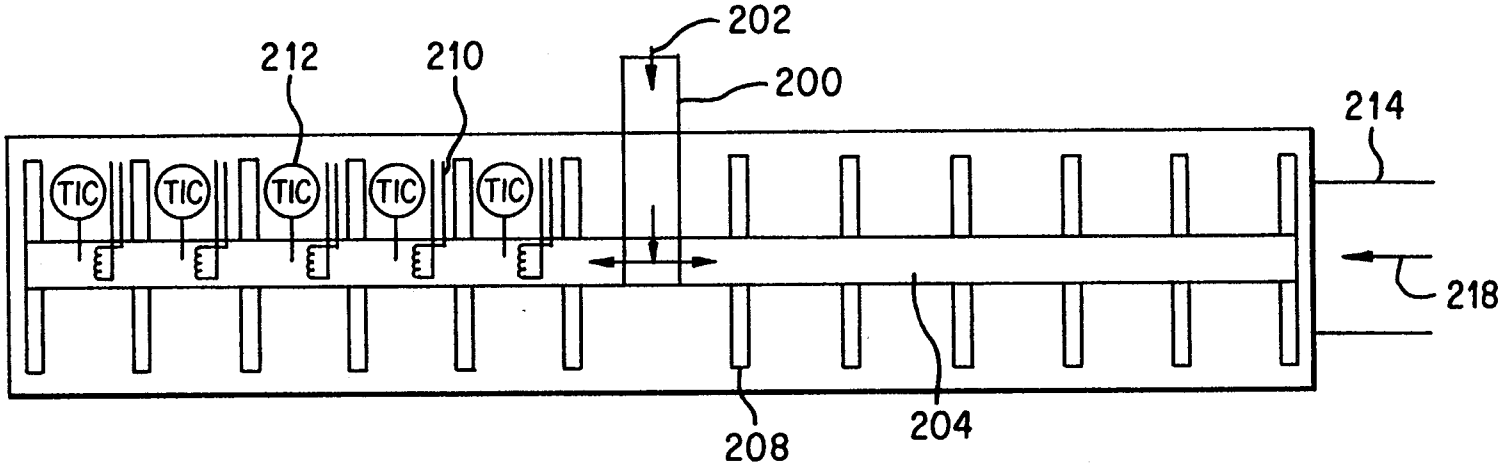
FIG. 9 is a top view of the dryer apparatus of the second preferred embodiment which has center fed air nozzles.
Figure 10:
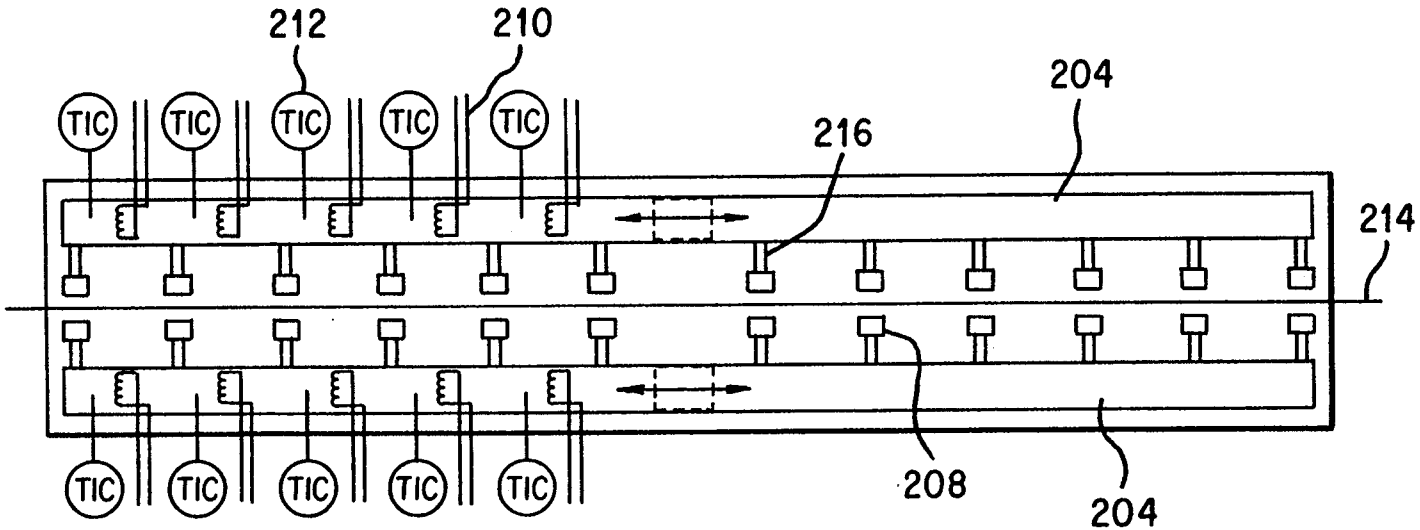
FIG. 10 is a side view of the dryer apparatus which has center fed air nozzles.

A second preferred embodiment of the present invention is shown in FIGS. 9 and 10. This embodiment uses center-fed air nozzles. An air intake duct 200 allows compressed, cooled and filtered air to move in the direction of arrow 202. The air travels down manifolds 204 and 206 which are centrally positioned over the nozzles 208. The manifolds 204 and 106 direct the air to the end of the dryer so that even pressure is applied throughout the dryer. Air impingement nozzles 208, as in the first preferred embodiment, run the full width of the substrate 214. The substrate 214 moves in the direction of arrow 218, encountering first the nozzles 208 containing cool air and progressively encountering nozzles 208 containing progressively hotter heated air. Air in the manifold 206 passes resistive heaters 210 and the temperature sensing element 212. As in the first preferred embodiment, temperature sensing is used to monitor the internal air temperature near the resistive heaters 210 to control the resistive heaters 210, thereby controlling the temperature of the air being applied to the polymer-solvent on the substrate 214. This system could also utilize a cool air injection and control system as described in the first preferred embodiment.

A side view of a dryer with center-fed air nozzles is shown in FIG. 10. There are two complete sets of manifolds 204 and 206, resistive heaters 210, thermocouples 212 and impingement nozzles 208. In this second preferred embodiment, similar to the first preferred embodiment, the heated air is applied to the top portion and bottom portion of the substrate 214. Air supply lines 216 supply air from the manifolds 204 and 206 to the air impingement nozzles 208. However, a dryer may have components to apply the heated air to only one side of the substrate 214.

Several modifications can be made to the previous embodiments, which would assist in temperature control of the temperature zones. A first modification incorporates refrigeration coils in the manifold 104 and 204. The coils would be energized to make the air progressively colder as it moves away from the air duct 100 and 200, respectively.

A second modification positions the air duct 100 at the end of manifold 104, where the substrate 114 enters the dryer. Resistive heaters 110 and thermocouples 112 could be placed along the full length of the manifolds 104 and 106 to heat the air to its final temperature at the last nozzle 108 of the dryer.

A third modification would place IR (radiant) heaters internally between the air nozzles inside the dryer to heat the web directly.

These preferred embodiments can be modified to be used with any process that involves the drying of any coated polymer-solvent layers including: polymer film casting; protective overcoating; package coating; paper overcoating; transparency coating, etc. Polymer film casting is a process in which a polymer webstock, usually 0.0005 to 0.010 inch thick, is formed by coating a polymer-solvent solution on a metal support. After a "green set time" where the solution sets, the coating is then peeled off and dried.

Although the invention has been described and illustrated with particularity, it is intended to be illustrative of preferred embodiments and understood that the present disclosure has been made by way of example only, and numerous changes in the combination and arrangements of the parts and features can be made by those skilled in the art without departing from the spirit and scope of the invention, as hereinafter claimed.

What is claimed is:

1. A drying apparatus for drying a layer of polymer-solvent solution on a substrate comprising:

at least one manifold for conducting a gas across the length of the drying apparatus;

a plurality of heating elements positioned in the at least one manifold to adjust the temperature of the gas; and a plurality of nozzles attached to the at least one manifold to direct the gas onto the substrate, each nozzle forming a temperature zone within the drying apparatus having a higher temperature than a preceding zone in a travel direction of the substrate.

2. The drying apparatus of claim 1, wherein a plurality of temperature sensing elements are located within the at least one manifold and spaced between the heating elements to monitor temperature of the gas flowing through the at least one manifold.

3. The drying apparatus of claim 2, wherein a computer monitors the plurality of temperature sensing elements in order to adjust the plurality of heating elements.

4. The drying apparatus of claim 1, wherein the at least one manifold comprises a single manifold connected to a center section of each nozzle of the plurality of nozzles and supplies the gas to the center of each nozzle.

5. The drying apparatus of claim 1, wherein the at least one manifold comprises two manifolds and each manifold is attached to an end of each nozzle of the plurality of nozzles in order to supply gas to each end of each nozzle.

6. The drying apparatus of claim 1, wherein a first manifold, a first plurality of heating elements and a first plurality of nozzles supply gas to a top portion of the substrate and a second manifold, a second plurality of heating elements and a second plurality of nozzles supply gas to a bottom portion of the substrate.

7. The drying apparatus of claim 1, wherein gas is supplied at a first end of the at least one manifold and the plurality of heating elements are distributed between the first end of the manifold and a second end of the manifold.

8. The drying apparatus of claim 1, wherein gas is supplied to a central portion of the at least one manifold, the plurality of heating elements are distributed between the central portion and a first end of the manifold, and cooling elements are distributed between the central portion and a second end of the manifold.

9. The drying apparatus of claim 1, wherein cooling gas is controllably supplied to each of the plurality of nozzles, the cooling gas and gas heated by the plurality of heating elements is mixed in order to further control the temperature of the gas applied to the substrate.

10. The drying apparatus of claim 1, wherein the substrate remains in each of the temperature zones for a maximum of 10 seconds and a maximum substrate heating rate of 10° F./second is applied to the substrate.

11. The drying apparatus of claim 1, wherein the substrate remains in each of the temperature zones for a maximum of 5 seconds and a maximum substrate heating rate of 5° F./second is applied to the substrate.

12. The drying apparatus of claim 1, wherein the gas is at least one of air, nitrogen and solvent-free gas.

13. A method for drying a layer of polymer-solvent solution on a substrate comprising the steps of:

supplying a gas to a plurality of different portions of the substrate moving in a travel direction, the gas forming a temperature zone;

selectively heating the gas so that the temperature of each temperature zone increases substantially continuously along the travel direction of the substrate; and controlling the temperature of the gas within each temperature zone to avoid defect formation in the drying of the layer of polymer-solvent solution.

14. The method of claim 13, wherein the plurality of zones form a gradual and continuous temperature gradient which changes from a lower temperature to a temperature close to the boiling point of the polymer-solvent solution.

15. The method of claim 13, wherein the gas is at least one of air, nitrogen and solvent-free gas.

16. The method of claim 13, wherein the substrate remains in each temperature zone for a maximum of 10 seconds and a maximum substrate heating rate of 10° F./second is applied to the substrate.

17. The method of claim 13, wherein the substrate remains in each temperature zone for a maximum of 5 seconds and a maximum substrate heating rate of 5° F./second is applied to the substrate.

18. A method using a drying apparatus for drying a layer of polymer-solvent solution on a substrate comprising the steps of:

conducting, with at least one manifold, a gas across the length of the drying apparatus;

positioning a plurality of heating elements in the at least one manifold to adjust the temperature of the gas;

directing, with a plurality of nozzles attached to the at least one manifold, the gas onto the substrate;

supplying radiant heat to a plurality of different portions of the substrate moving in a travel direction, the radiant heat forming a temperature zone, each temperature zone having a higher temperature than a preceding temperature zone along the travel direction of the substrate; and controlling the temperature within each temperature zone to avoid defect formation in the drying of the thick layer of polymer-solvent solution.

19. The method of claim 18, wherein the plurality of zones form a gradual and continuous temperature gradient which changes from a lower temperature to a temperature close to the boiling point of the polymer-solvent solution.

20. The method of claim 18, wherein the substrate remains in each temperature zone for a maximum of 10 seconds and a maximum substrate heating rate of 10° F./second is applied to the substrate.

21. The method of claim 18, wherein the substrate remains in each temperature zone for a maximum of 5 seconds and a maximum substrate heating rate of 5° F./second is applied to the substrate.

* * * * *